United States Patent [19]

Hüsemann et al.

[11] 4,355,924

[45] Oct. 26, 1982

[54] TUNNEL-DRIVING APPARATUS

[75] Inventors: Heinz Hüsemann, Werne; Klaus Linde, Lunen, both of Fed. Rep. of Germany

[73] Assignee: Gewerkschaft Eisenhutte Westfalia, Lunen, Fed. Rep. of Germany

[21] Appl. No.: 181,505

[22] Filed: Aug. 26, 1980

[30] Foreign Application Priority Data

Sep. 6, 1979 [DE] Fed. Rep. of Germany ..... 2936067

[51] Int. Cl.[3] ..... E01G 3/02

[52] U.S. Cl. ..... 405/145; 405/141

[58] Field of Search ..... 405/145, 146, 141, 144, 405/147, 138, 150, 288; 299/31-33

[56] References Cited

U.S. PATENT DOCUMENTS

| | | | |
|---|---|---|---|
| 3,373,572 | 3/1968 | Kemper | 405/143 X |
| 3,926,005 | 12/1975 | Foik | 405/143 |
| 4,048,806 | 9/1977 | Stuckmann et al. | 405/145 |
| 4,063,425 | 12/1977 | Jutte et al. | 405/145 |
| 4,120,165 | 10/1978 | Stuckmann et al. | 405/145 |
| 4,252,463 | 2/1981 | Klysz | 405/145 |

*Primary Examiner*—Dennis L. Taylor

*Attorney, Agent, or Firm*—Sughrue, Mion, Zinn, Macpeak and Seas

[57] ABSTRACT

Apparatus for use in driving tunnels or the like has a main shield composed of elongate drive members supported and guided on a rigid frame as known per se. Rams serve to advance the drive members and the frame in alternative to effect the driving operation. A rear shield or cover is located behind the main shield. This rear shield is composed of elongate rear extension members connected with some of the drive members over the roof and part of the side walls of the tunnel. Supports fixed to the rear of the frame of the main shield engage beneath the lowermost rear extension members to support the rear shield. The supports, disposed symmetrically at either side of the axis of the tunnel, have brackets engaging with the lowermost rear extension members and these brackets can be displaced by piston and cylinder units to raise or lower the entire rear shield.

13 Claims, 3 Drawing Figures

TUNNEL-DRIVING APPARATUS

BACKGROUND OF THE INVENTION

The present invention relates to apparatus usable to drive tunnels, galleries, headings, adits or similar underground cavities or excavations all referred to hereinafter as "tunnels" for convenience.

It is well known to drive a tunnel with the aid of a drive or knife shield composed of elongate knives or drive members supported and guided for longitudinal movement on a frame. The drive members are advanced to penetrate a working face by means of hydraulic rams and when all the drive members have been advanced the frame is drawn up. To support the tunnel wall behind the shield various measures have been adopted in the past. Thus, for example, it is known to provide elongate rear tails or extensions which are linked to the drive members and form a rear shield in which a lining, permanent or otherwise, can be installed. The specifications for U.S. Pat. Nos. 4,118,938 and 4,120,165, assigned to the same assignee as the present application, describe typical prior art apparatus. It is also known to brace the rear extensions against the tunnel wall with the aid of expanding devices thereby to prevent subsidence—see German patent specification 2353248. The expanding devices for bracing the rear extensions can be associated with lining elements installed in the rear shield or mounted on the frame of the main shield.

It is known also to provided individual hydraulic expanding devices for the drive members which act to brace these drive members against the tunnel wall. Conveniently, these devices can form thrust bearings for the rams which shift the drive members in the advancing direction. The selective operation of the expanding devices permits control of the tunnel direction so that any tendency to deviate from a desired course can be corrected. The provision of expanding devices for all the drive members involves considerable expense however.

A general object of the present invention is to provide an improved form of tunnel driving apparatus.

SUMMARY OF THE INVENTION

Tunnel driving apparatus constructed in accordance with the invention comprises a plurality of elongate drive members, frame means for supporting and guiding the drive members for longitudinal displacement and rear extension members flexibly connected with some of the drive members to form a rear shield cover. In accordance with the invention the lowermost rear extension members are supported by means mounted to the rear of the frame means and the support means is adjustable to raise and lower the rear shield cover. The support means can be provided with adjustment means which permits the raising and lowering of the rear shield or cover as a unit. This gives rise to particularly effective directional control during the tunnel driving operation especially with regard to inclination, and in contrast to the prior art the adjustable support means can be simple, compact and provided at relatively low cost. The distance over which the rear shield needs to be raised and lowered for control purposes is quite small and can amount to 10–60 mm.

The adjustment means for raising and lowering the rear shield may take the form of a pair of hydraulic piston and cylinder units. Because the arcuate rear shield is adequately supported by the support means at all times the introduction of lining elements therein is facilitated. Where the tunnel is driven in material prone to subsidence the support means can serve to brace the rear extension members firmly against the roof and part of the side walls of the tunnel.

It is desirable to provide connection joints between the rear extension members and associated drive members which permit the raising and lowering of the rear shield. Conveniently, omnidirectionally flexible joints can be provided for this purpose. One design for the support means, described hereinafter, has mounting bodies fixed to the frame means, and brackets displaceably guided on the bodies and having support surfaces engaging with the lowermost rear extension members of said rear shield. The brackets can be displaceably guided and connected to the bodies with the aid of T-shaped tongue-and-groove connections. The support surfaces engage beneath the bottom edges of the lowermost rear extension members and these surfaces preferably move along paths extending at an angle to the vertical and generally transverally of these lowermost members. These paths can be arcuate with an axis of curvature on the central vertical plane through the apparatus. The rear extension members can be interconnected at their mutually-facing longitudinal edges by means of tongue-and-groove connections. This gives rise to a certain free movement or clearance which has to be taken up before the entire rear shield can be raised as a unit. Other forms of connection means can be utilized to interconnect the rear extension members so as to unify the rear shield while permitting relatively longitudinal displacement between the rear extension members.

The invention may be understood more readily, and various other aspects and features of the invention, may become apparent from consideration of the following description.

BRIEF DESCRIPTION OF DRAWING

An embodiment of the invention will now be described, by way of example only, with reference to the accompanying drawings, wherein.

DESCRIPTION OF PREFERRED EMBODIMENT

Figure 2:
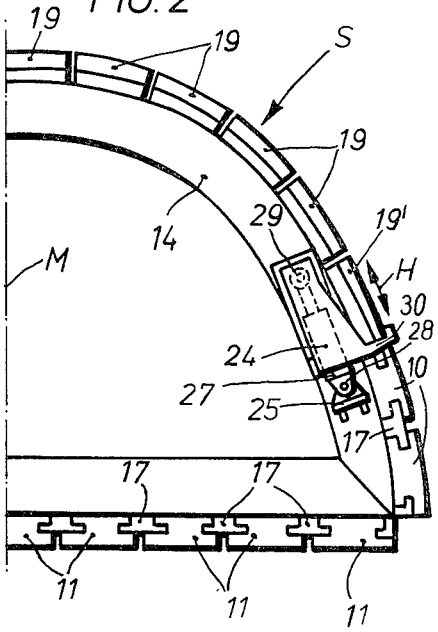
FIG. 2 is a sectional end view of a lateral part of the apparatus shown in FIG. 1, the view being taken in the direction of arrow II in FIG. 1.

As shown in the drawings, an apparatus constructed in accordance with the invention is composed of a number of elongate drive members (also called knives or planks) 10, 11 which are arranged in side-by-side parallel relationships to form a main forward shield with a flat floor region surmounted by an arcuate upper region. The drive members 10, which form the upper shield region are supported and guided for longitudinal displacement on frame means 12. This frame means 12 takes the form of curved frame components 13, 14 linked together by longitudinal struts 15 and diagonal struts 16 to from a rigid structure. The guidance between the frame means 12 and the individual drive members 10 can be formed by T-shaped grooves and guide blocks. The drive members 10 contact the roof and side walls of a tunnel produced by the apparatus and having a shape defined by the main shield. The drive members 11 rest on the floor 22 of the tunnel and are likewise linked to the frame components 13, 14 with the aid of T-shaped grooves and guide blocks as represented by reference numeral 17 in FIG. 2.

Figure 1:
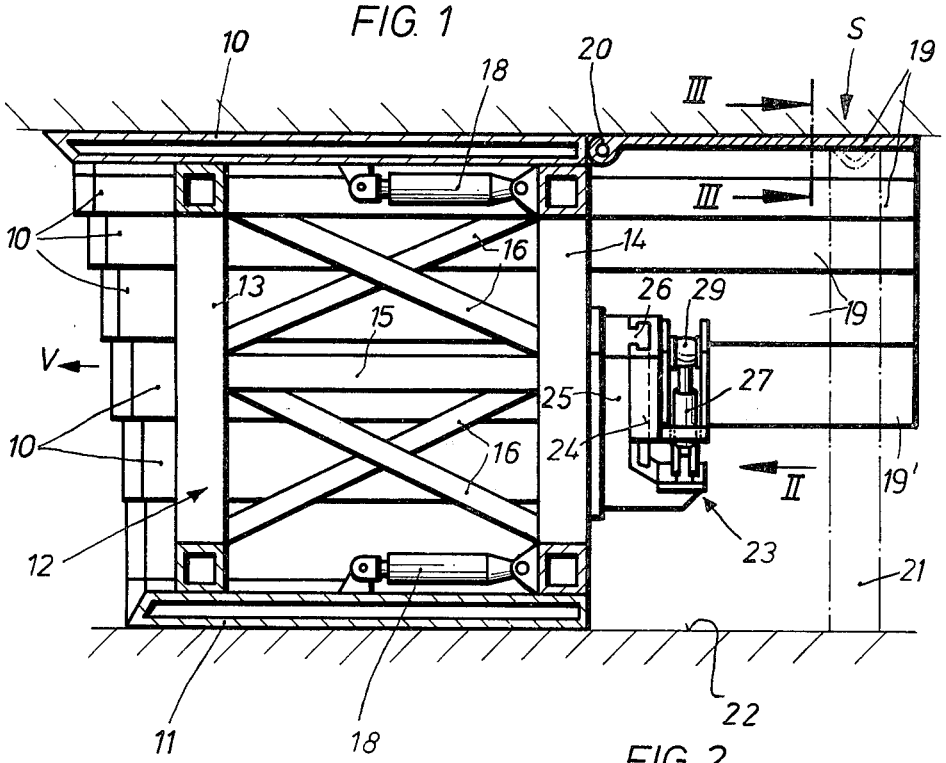
FIG. 1 is a schematic sectional side view of apparatus constructed in accordance with the invention.

The drive members 10, 11 are displaced in relation to the frame means 12 individually or in groups in the driving direction V with the aid of hydraulic rams 18 articulated between the frame component 14 and the members 10, 11. For the sake of clarity only two rams 18 are shown in FIG. 1. During use, tunnel driving or advancement is effected by pressing the drive members 10, 11 forward in the direction of arrow V individually or in groups by feeding pressure fluid to the appropriate rams 18. The members 10, 11 then penetrate a working face in front of the main shield, if so desired. The frame means 12 and the stationary members 10, 11 in frictional contact with the tunnel floor and wall act as an abutment for the shifting forces and the or each shifted member 10, 11 is guided by the frame means 12 for longitudinal motion. When all the members 10, 11 have been advanced the rams 18 are operated in a reverse sense to draw up the frame means 12 and the members 10, 11 collectively form an abutment. Any spoil or debris can be removed from the working face in front of the main shield by known means.

Some of the drive members 10 which form the top portion of the upper shield region are provided with rear extensions or tail members 19 which provide an arcuate rear shield S for the apparatus. The members 19 are elongate smooth-surfaced thin metal plates whereas the drive members 10, 11 are stout profiled parts. The rear members 19 are connected with their associated drive members 10 with the aid of pivot joints 20. These joints 20, depicted schematically in FIG. 1, are preferably omnidirectional flexible joints with a certain degree of freedom.

Figure 3:
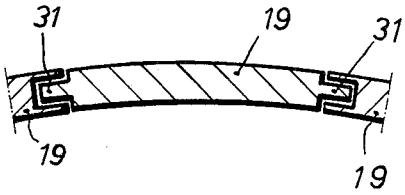
FIG. 3 is a sectional end view of an upper rear part of the apparatus shown in FIG. 1, the view being taken along the line III—III of FIG. 1.

As shown in FIG. 3, the members 19 forming the rear shield S are interconnected at their mutually-facing longitudinal edges via tongue-and-groove connections 31. The rear shield S formed by the parallel rear members 19 serves to support the tunnel roof and wall in the zone immediately behind the main shield. As the tunnel is driven forwards in the manner described lining elements, such as tubbing rings or multipart arcuate sections, are introduced into the rear shield as represented by the chain-dotted lines 21 in FIG. 1. These lining elements 21 which eventually support the tunnel roof and side walls exposed behind the apparatus rest on the floor 22 of the tunnel and also support the rear shield S temporarily. As the drive members 10 are advanced in the manner described the associated rear members 19 follow up and are thus successively withdrawn from the gap between the elements 21 and the tunnel roof and walls. The lining elements 21 are progressively introduced into the rear shield S so that the rear shield S is supported at all times.

The rear shield S can be raised and lowered as a unit in relation to the main shield i.e. the frame means 12 and the drive members 10, 11. To achieve this the rear frame component 14 is provided with a pair of rearwardly extending supports 23 disposed symmetrically on both sides of a vertical median plane M through the apparatus.

Each support 23 is composed of a main body 25 fixed to the frame component 14 and a bracket 24 movably carried by the body 25. Each bracket 24 is guided on the body 25 so that it can be generally raised or lowered say around an arcuate path conforming with the shield S and with its axis of curvature on the plane M. The paths along which the brackets 24 move can be linear in which case they are inclined to the vertical and extend transversally of the lowermost rear extension members 19'. A T-shaped groove and guide block arrangement 26 can be provided for guiding the brackets 24 on the mounting bodies 25. A hydraulic piston and cylinder unit 27 is provided between each body 25 and its associated bracket 24 to adjust the latter. Each unit 27 has its cylinder connected with a swivel joint 28 to the associated body 25 while its piston rod is similarly connected with a swivel joint 29 to the associated bracket 24. The brackets 24, which can thus be displaced with the aid of the units 27, are formed with support surfaces 30 (FIG. 2) which engage beneath the lowermost edge of the lowest members 19' of the rear shield S. As the units 27 are extended or retracted, the brackets 24 are displaced in the directions of arrow H, FIG. 2, to raise or lower the lowest member 19'.

The connections 31 (FIG. 3) between the members 19 guide the members 19 longitudinally and restrain lateral movement to unify the shield S. The connections 31 provide a certain clearance between adjacent members 19 and this permits a certain amount of free-movement in the lateral sense. Once this free movement has been taken up by the lateral abutment of the connections 31 the shield S can be moved as a whole by the units 27. The units 27 are preferably provided with individual control valves (manually-operated or otherwise) in conjunction with pressure limiting valves. The connections 31 permit some flexibility but ensure the members 19 cannot become detached from one another. The raising or lowering of the rear shield S accomplished by the operation of the units 27 is particularly effective in controlling the direction in which the tunnel is being driven. This control can be enhanced or supplemented by operating the rams 18 to give priority to certain drive members 10, 11 or groups of members 10, 11 during their advancement. The selective operational control of the rams 18 is particularly effective in varying the lateral direction taken by the apparatus while the units 27 serve best to control the inclination thereof.

We claim:

1. Apparatus for use in driving tunnels; said apparatus comprising a main forward shield composed of a plurality of elongate drive members (10, 11), frame means (12) supporting the drive members for individual longitudinal displacement, ram means (18) operable to alternately advance the drive members and the frame means to effect the driving operation, an arcuate upper rear shield (S) composed of a plurality of rear elongate extension members (19) associated with an upper group composed of some of the drive members and displaceable therewith, support means (23) mounted directly on the frame means and supportively engaging lowermost members of the rear shield, and adjustment means (27) for the support means enabling the rear shield as a whole to be raised and lowered bodily in relation to the main shield.

2. In tunnel driving apparatus comprising a plurality of elongate drive members (10, 11), frame means (12) for supporting and guiding the drive members for longitudinal displacement, and a plurality of rear extension members (19) flexibly connected with an upper group of the drive members to form a rear shield cover (S); the improvement comprising: the lowermost rear extension members (19') being elevated from a floor of the tunnel and supported by means (23) mounted to a rear portion (14) of the frame means, and the support means being adjustable (27) to raise and lower the rear shield cover as a whole.

3. Apparatus according to claim 1, wherein the adjustment means comprises hydraulic piston and cylinder units.

4. Apparatus according to claim 1, wherein the support means comprises bodies fixed to the frame means, and brackets displaceably guided on the bodies and having support surfaces engaging with the lowermost rear extension members of said rear shield.

5. Apparatus according to claim 4, wherein the adjustment means comprises hydraulic piston and cylinder units connected between the bodies and the brackets.

6. Apparatus according to claim 4, wherein the brackets are displaceably guided and connected to the bodies with the aid of T-shaped tongue-and-groove connections.

7. Apparatus according to claim 4, wherein the brackets are guided for movement along paths which are inclined to the vertical and extend generally transversally of the lowermost rear extension members.

8. Apparatus according to claim 1, wherein the rear extension members are interconnected and guided at the mutually-facing longitudinal edges.

9. Apparatus according to claim 8, wherein said edges of the rear extension members are interconnected by means of tongue-and-groove connections.

10. Apparatus according to claim 1, wherein each rear extension member is connected to an associated one of the drive member by means of an omnidirectional flexible joint to facilitate the raising and lowering of the rear shield.

11. Apparatus according to claim 1, wherein the main shield has a floor region composed of some of the drive members resting on the floor of the tunnel and an upper arcuate region composed of the remainder of said drive members and wherein the rear shield has rear extension members connected with pivot joints to some of the drive members in the upper region of the main shield.

12. Apparatus according to claim 1, wherein the drive members are connected to and guided on the frame means with the aid of T-shaped tongue-and-groove connections.

13. Apparatus according to claim 1, wherein connection means interconnects the rear extension members to unify the rear shield while permitting relative longitudinal displacement between the rear extension members.

* * * * *